US009254403B2

(12) United States Patent
Wertz et al.

(10) Patent No.: US 9,254,403 B2
(45) Date of Patent: Feb. 9, 2016

(54) JOINT REHABILITATION STRAP AND METHOD OF USING THE SAME

(71) Applicant: Peathry, LLC, Gibsonia, PA (US)

(72) Inventors: Charles M. Wertz, Gibsonia, PA (US); Ronald W. Brand, Jr., Beaver Falls, PA (US)

(73) Assignee: Peathry, LLC, Gibsonia, PA (US)

( * ) Notice: Subject to any disclaimer, the term of this patent is extended or adjusted under 35 U.S.C. 154(b) by 15 days.

(21) Appl. No.: 14/215,103

(22) Filed: Mar. 17, 2014

(65) Prior Publication Data

US 2014/0274615 A1 Sep. 18, 2014

Related U.S. Application Data

(60) Provisional application No. 61/791,375, filed on Mar. 15, 2013.

(51) Int. Cl.

| | |
|---|---|
| ***A63B 21/00*** | (2006.01) |
| ***A61H 1/02*** | (2006.01) |
| ***A63B 23/035*** | (2006.01) |
| ***A63B 23/04*** | (2006.01) |

(52) U.S. Cl.

CPC ..... *A63B 21/00185* (2013.01); *A61H 1/0255* (2013.01); *A63B 21/00043* (2013.01); *A63B 21/00178* (2013.01); *A63B 21/4034* (2015.10); *A63B 21/4035* (2015.10); *A63B 23/03508* (2013.01); *A63B 23/0405* (2013.01); *A61H 2201/0153* (2013.01); *A61H 2201/1269* (2013.01); *A61H 2203/0456* (2013.01); *A63B 21/00181* (2013.01); *A63B 2208/0252* (2013.01)

(58) Field of Classification Search

CPC ..... A63B 21/00
USPC ..... 482/121, 126, 105, 907
See application file for complete search history.

(56) References Cited

U.S. PATENT DOCUMENTS

| | | | | |
|---|---|---|---|---|
| 2004/0084490 | A1* | 5/2004 | Caputi | 224/257 |
| 2004/0157710 | A1* | 8/2004 | Basting | 482/126 |
| 2007/0084893 | A1* | 4/2007 | Godshaw et al. | 224/257 |
| 2007/0238591 | A1* | 10/2007 | Makofsky | 482/126 |
| 2014/0084038 | A1* | 3/2014 | Moles | 224/607 |

* cited by examiner

*Primary Examiner* — Jerome W Donnelly
(74) *Attorney, Agent, or Firm* — Jeffrey D. Mulrooney

(57) ABSTRACT

The present invention is directed to a rehabilitation strap including a pair of handles and a strap of adjustable length and a method of using the same. The method includes rehabilitation exercises that an individual may practice after a joint replacement procedure.

10 Claims, 12 Drawing Sheets

JOINT REHABILITATION STRAP AND METHOD OF USING THE SAME

CROSS REFERENCE TO RELATED APPLICATIONS

This application is related to and claims priority from U.S. Provisional Patent Application No. 61/791,375 filed Mar. 15, 2013 and is hereby incorporated by reference in its entirety.

BACKGROUND OF THE INVENTION

1. Field of the Invention

The present invention relates generally to rehabilitation equipment and methods. More particularly, it relates to a rehabilitation strap including a pair of handles and a strap of adjustable length and a method of using the same. The method includes rehabilitation exercises that an individual may practice after a joint replacement procedure.

2. Description of Related Art

Rehabilitation is a required but difficult process for patients trying to recover the full control of their hips, knees, or other parts of their body. Some of the most important types of rehabilitation include muscle and ligament rehabilitation for patients with one or more hip, knee, or ankle replacement surgeries.

Although procedures such as hip and knee replacement surgery can be very beneficial, the best way to maximize those benefits is through proper rehabilitation. The number of total hip and knee replacements is expected to increase substantially as populations age and individuals live longer. Physical therapy is extremely important in the overall outcome of any joint-replacement surgery. The goals of physical therapy are to prevent contractures, improve patient education, and strengthen muscles through controlled exercises. Contractures result from scarring of the tissues around the joint. Contractures do not permit full range of motion and, therefore, impede mobility of the replaced joint. Once a contracture develops it cannot be stretched or exercised away, it must be released with orthopedic surgery which is almost always very expensive and physically painful for the patient.

Many of the exercises used during rehabilitation from a joint replacement procedure require moving a patient's limbs, typically the legs, since most joint replacement procedures are for the knee or hip. Most patients do not have the needed strength and/or range of motion after a joint replacement procedure to practice these essential excises properly and frequently enough.

Therefore, there is a need for a device and method for aiding in moving a patient's leg or legs in order to most optimally rehabilitate the patient.

SUMMARY OF THE INVENTION

The present invention is directed to a rehabilitation strap including a pair of handles and a strap of adjustable length and a method of using the same. The method includes rehabilitation exercises that an individual may practice after a joint replacement procedure.

In one embodiment, the present invention is a rehabilitation device including a flexible elongate body having a first end and a second end, a first D-shaped member flexibly coupled to the first end of said flexible elongate member, a second D-shaped member flexibly coupled to the second end of said flexible elongate member, a first handle attached to the first D-shaped member, a second handle attached to the second D-shaped member, wherein the first D-shaped member, the second D-shaped member, the first handle and the second handle are configured to prevent pinching of a user's hand when said user is gripping the first handle or the second handle. In another embodiment, the first D-shaped member, the second D-shaped member, the first handle and the second handle are configured to prevent at least one of the first handle and the second handle from contacting the flexible elongate body. In yet another embodiment, a length of the flexible elongate body is adjustable among a plurality of lengths. In still another embodiment, the flexible elongate body is configured as a strap. In still yet another embodiment, the flexible elongate body is configured as a cord.

In another embodiment, the invention is a method of rehabilitating a joint, including the steps of providing a flexible elongate body having a first end and a second end, providing a first D-shaped member flexibly coupled to the first end of said flexible elongate member, providing a second D-shaped member flexibly coupled to the second end of said flexible elongate member, providing a first handle attached to the first D-shaped member, providing a second handle attached to the second D-shaped member, wherein the first D-shaped member, the second D-shaped member, the first handle and the second handle are configured to prevent pinching of a user's hand when said user is gripping the first handle or the second handle, gripping the first handle with a first hand of a user, gripping the second handle with a second hand of the user, positioning a portion of the flexible elongate body on a portion of a limb of the user so as to mechanically couple the flexible elongate body to the limb of the user, and moving the limb at least in part by the user pulling on at least one of the first handle and the second handle, thereby actuating a joint of the user. In yet another embodiment the first D-shaped member, the second D-shaped member, the first handle and the second handle are configured to prevent at least one of the first handle and the second handle from contacting the flexible elongate body. In still another embodiment, a length of the flexible elongate body is adjustable among a plurality of lengths. In yet still another embodiment, the flexible elongate body is configured as a strap. In still yet another embodiment, the flexible elongate body is configured as a cord.

DETAILED DESCRIPTION OF THE INVENTION

The present invention is directed to a rehabilitation strap including a pair of handles and a strap of adjustable length and a method of using the same.

Figure 1:
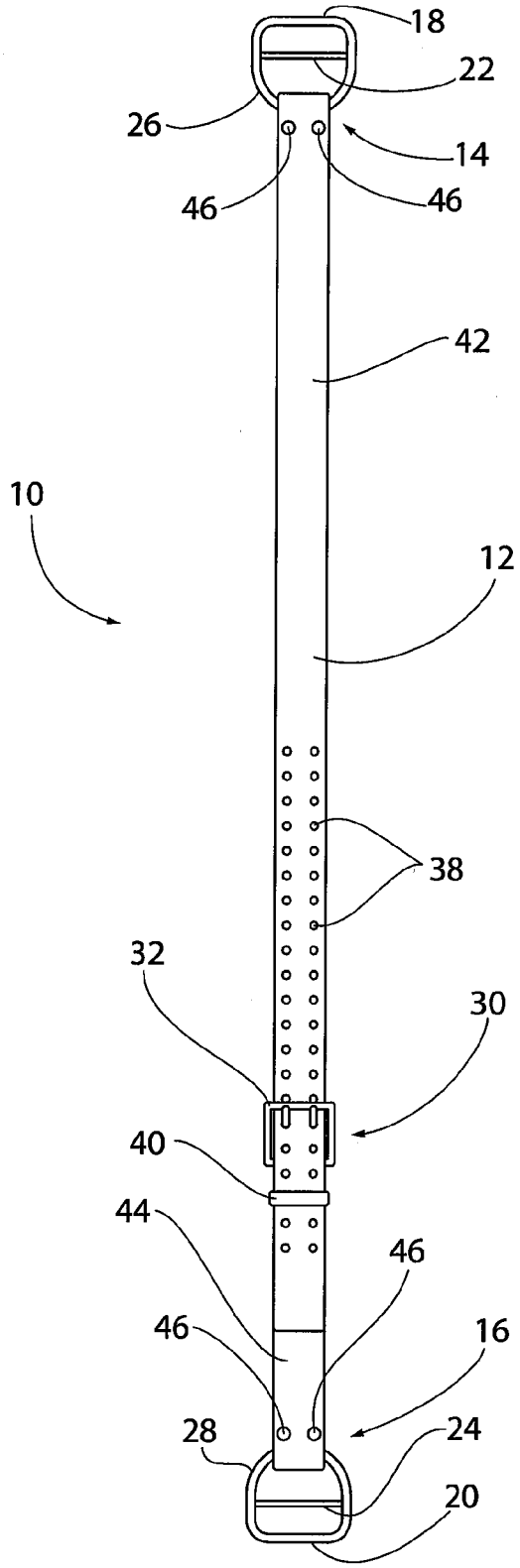
FIG. 1 is a plan view of a joint rehabilitation strap made in accordance with the present invention.
Figure 2:
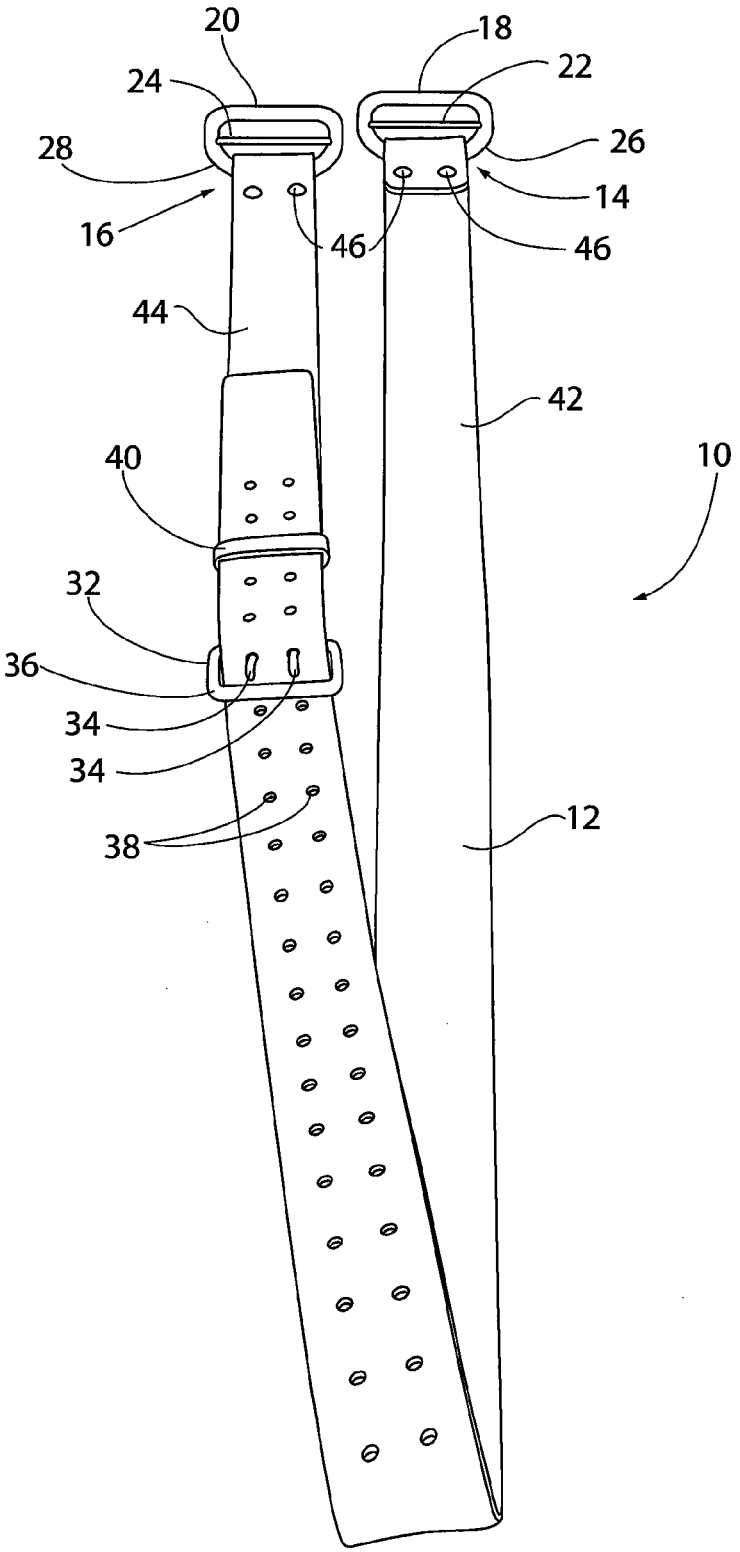
FIG. 2 is a perspective view of the joint rehabilitation strap shown in FIG. 1.
Figure 3:
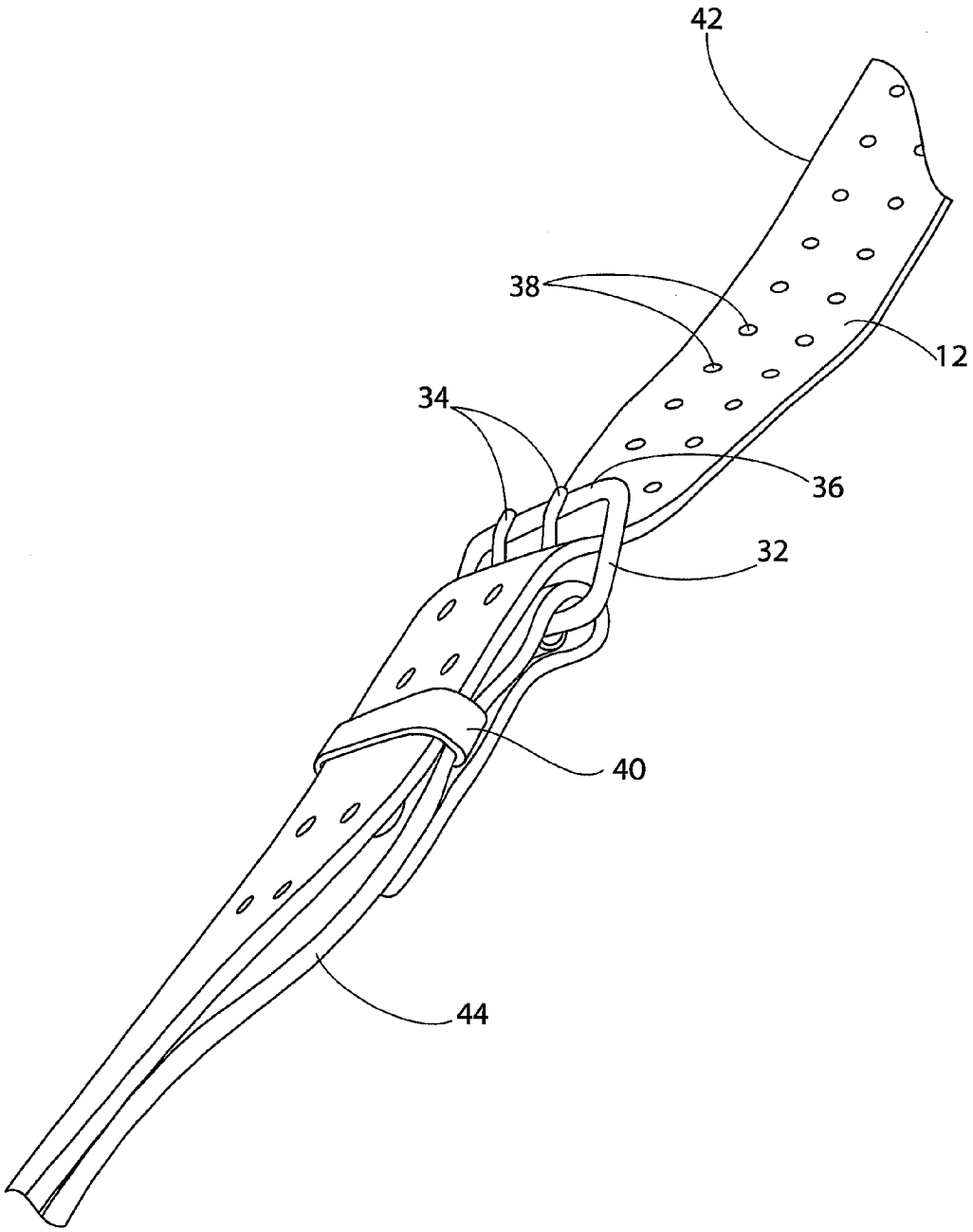
FIG. 3 is a close-up side perspective view of the buckle of the joint rehabilitation strap shown in FIG. 1.
Figure 4:
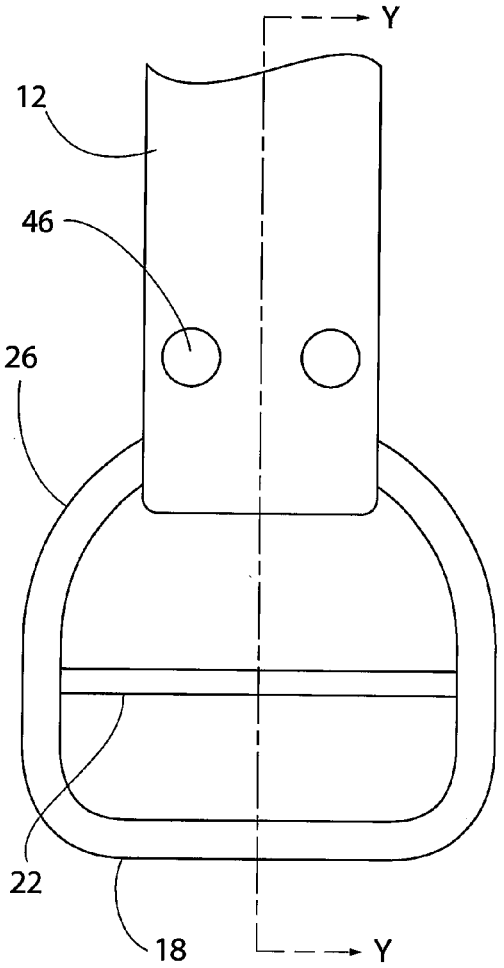
FIG. 4 is a close-up plan view of a handle attached to the joint rehabilitation strap made in accordance with the present invention shown in FIG. 1.
Figure 5:
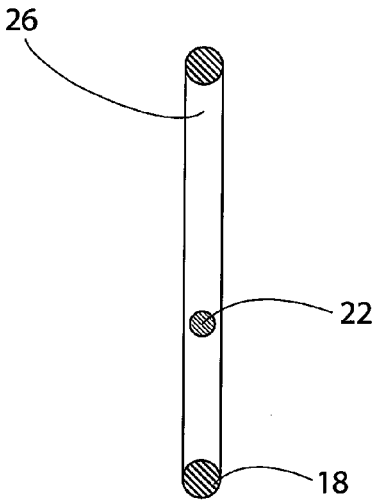
FIG. 5 is a cross-sectional view of the handle along line y shown in FIG. 4.

Referring to FIGS. 1-5, there is shown a rehabilitation strap 10. The rehabilitation strap 10 includes a flexible elongate body 12 having a first end 14 and a second end 16. The first end 14 and the second end 16 of flexible elongate body 12 have a first handle 18 and a second handle 20 attached to each respectively. The first handle 18 and the second handle 20 may have a first anti-pinch member 22 and a second anti-pinch member 24 defining a first D-shaped member 26 and a second D-shaped member 28. The flexible elongate body 12 may have a length adjustment apparatus 30. Length adjustment apparatus 30 is shown as buckle 32, however, any length adjustment apparatus capable of maintaining a desired length during exercise could be used. Buckle 32 comprises prongs 34, bar 36, apertures 38, and strap retainer member 40. If a buckle 32 is used, then flexible elongate body 12 may be formed as two sections, primary flexible elongate body portion 42 and secondary flexible elongate body portion 44. The first handle 18, the second handle 20, the first anti-pinch member 22, the second anti-pinch member 24, the first D-shaped member 26 and the second D-shaped member 28 may be connected to flexible elongate body 12 via folding the flexible elongate body 12 over one or more of them and riveting the flexible elongate body 12 to itself with rivets 46 or another fastener as shown in FIGS. 1, 2 and 4.

The flexible elongate body 12 may be constructed of any flexible material that can at least substantially maintain its length during rehabilitation exercises. For example, leather, fabrics, woven fabrics, cords, cables, metal cords, metal cables, and even chains. While the material used for the flexible elongate body 12 may be elastic or highly elastic, this is not preferred for many rehabilitation exercises, but could be very useful for other exercises.

The first handle 18, the second handle 20, the first anti-pinch member 22, the second anti-pinch member 24, the first D-shaped member 26 and the second D-shaped member 28 may be formed of any suitable material. However, it is envisioned that they are constructed from at least one polymer or resin. For example, polypropylene could be used to form the first handle 18, the second handle 20, the first anti-pinch member 22, the second anti-pinch member 24, the first D-shaped member 26 and the second D-shaped member 28.

Figure 6:
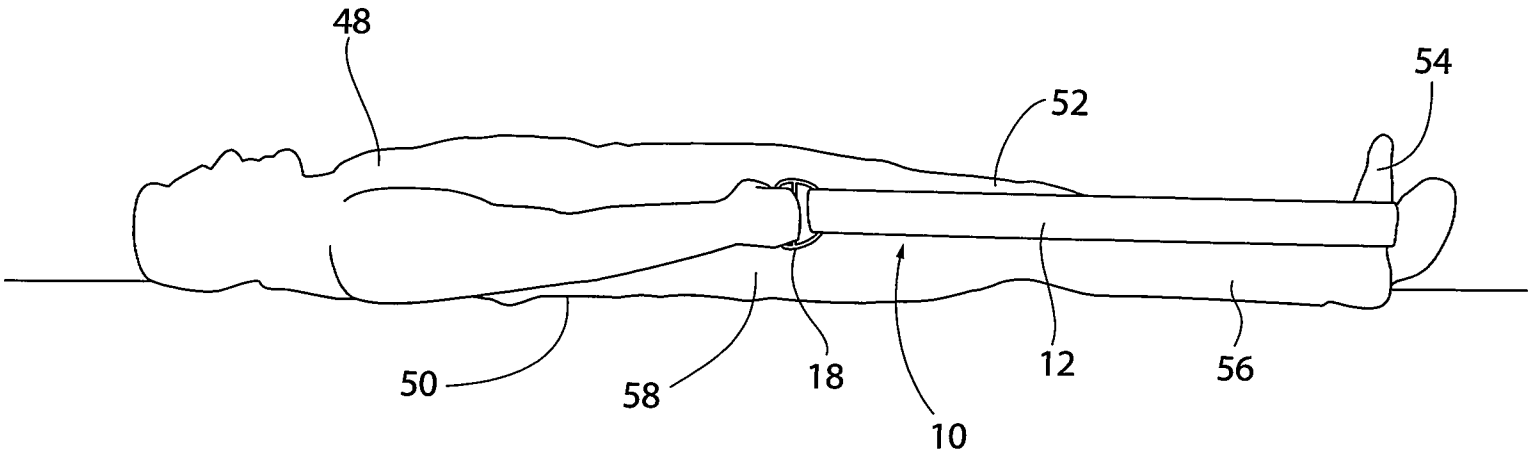
FIG. 6 is a side view of a user in a starting position for assisted leg bends with the aid of the joint rehabilitation strap made in accordance with the present invention shown in FIG. 1.
Figure 7:
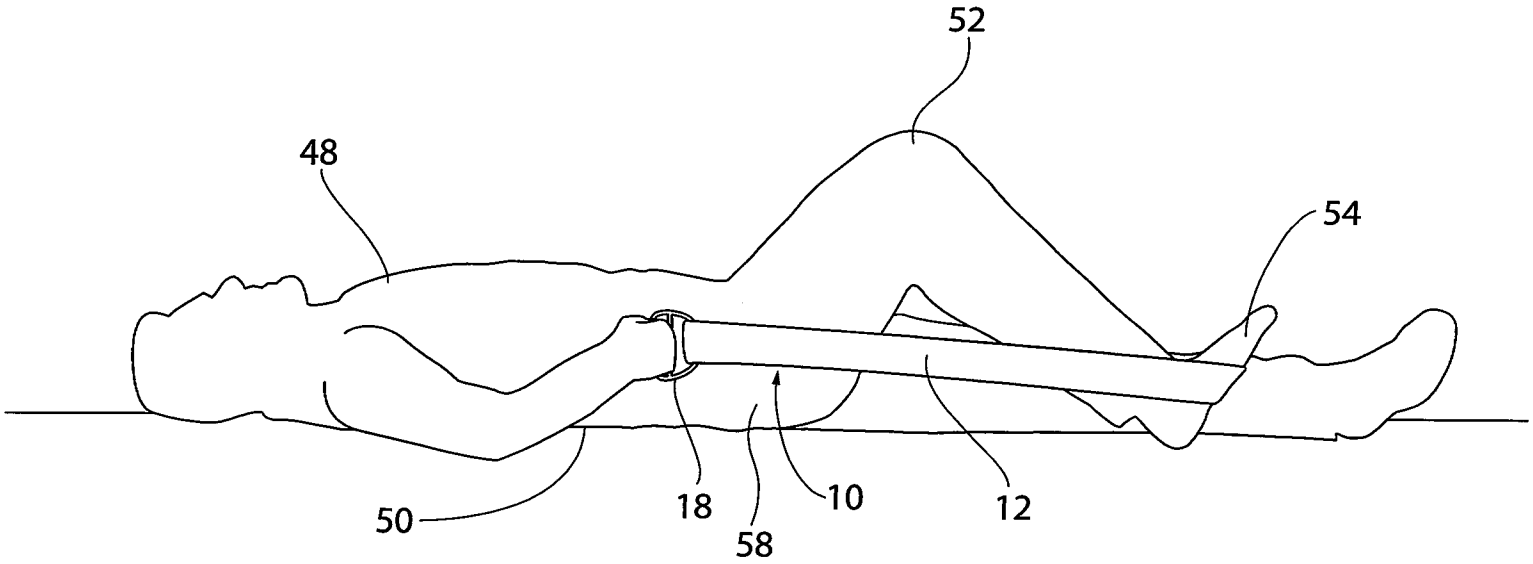
FIG. 7 is a side view of a user in an intermediate position for assisted leg bends with the aid of the joint rehabilitation strap made in accordance with the present invention shown in FIG. 1.
Figure 8:
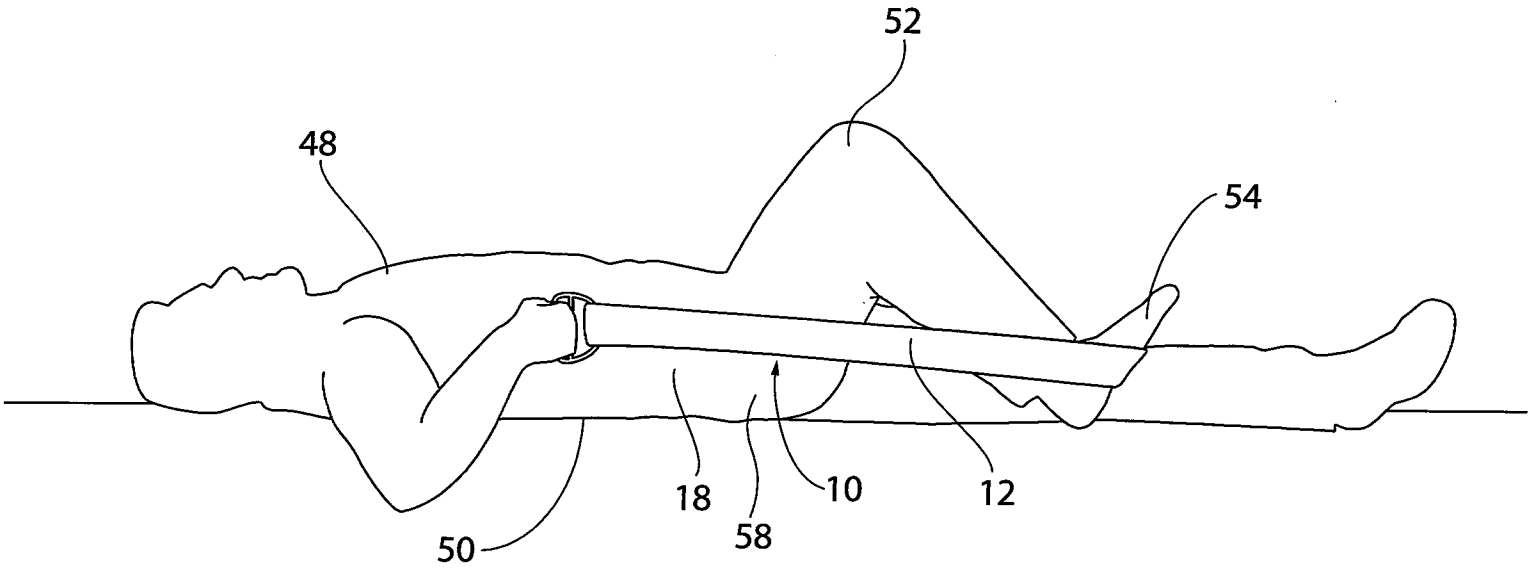
FIG. 8 is a side view of a user in a final position for assisted leg bends with the aid of the joint rehabilitation strap made in accordance with the present invention shown in FIG. 1.

Referring to FIGS. 6-8, there is shown a user 48 using the rehabilitation strap 10 to perform assisted leg bends. This exercise is performed by the user 48 lying on their back 50, placing the flexible elongate body 12 along the bottom of the user's foot 54. The user 48 then bends the user's knee 52 and concurrently pulls on handles 18 and 20 (20 not shown) to apply pressure through the flexible elongate body 12 to increase the bend at the user's knee 52 and rotate hip 58. To complete the exercise, the user 48 straightens their knee 52 and hip 58. This procedure is repeated a number of times during each therapy or exercise session.

Figure 9:
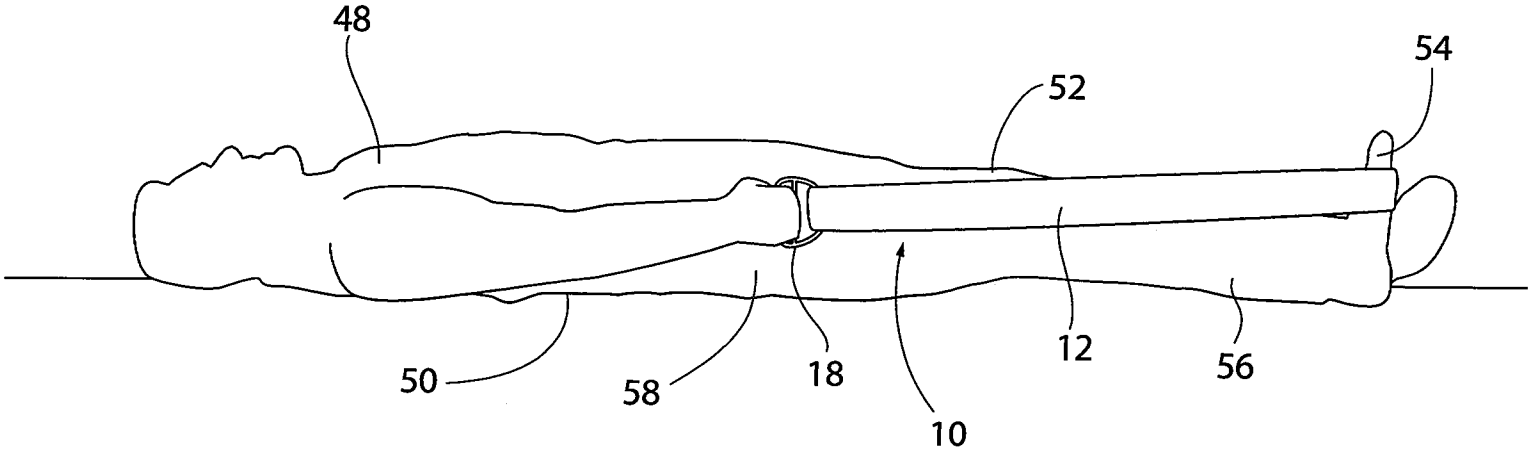
FIG. 9 is a side view of a user in position for an assisted plantar fasciitis stretch with the aid of the joint rehabilitation strap made in accordance with the present invention shown in FIG. 1.

Referring to FIG. 9, there is shown a user 48 using the rehabilitation strap 10 to perform an assisted plantar fasciitis stretch. This exercise is performed by the user 48 lying on their back 50, placing the flexible elongate body 12 along the bottom of the user's foot 54, specifically on the balls of the user's foot 54. The user 48 then holds this position while concurrently pulling on handles 18 and 20 (20 not shown) to apply pressure through the flexible elongate body 12 to stretch the user's plantar fasciitis. Then this position is held for several seconds or more before the user stops. This procedure is repeated a number of times during each therapy or exercise session.

While only two rehabilitation exercises are shown, it is envisioned that many other exercises could be performed. Particularly it is envisioned that the present invention can aid in any exercise that requires a user to move a lower limb or part of a lower limb.

Figure 10:
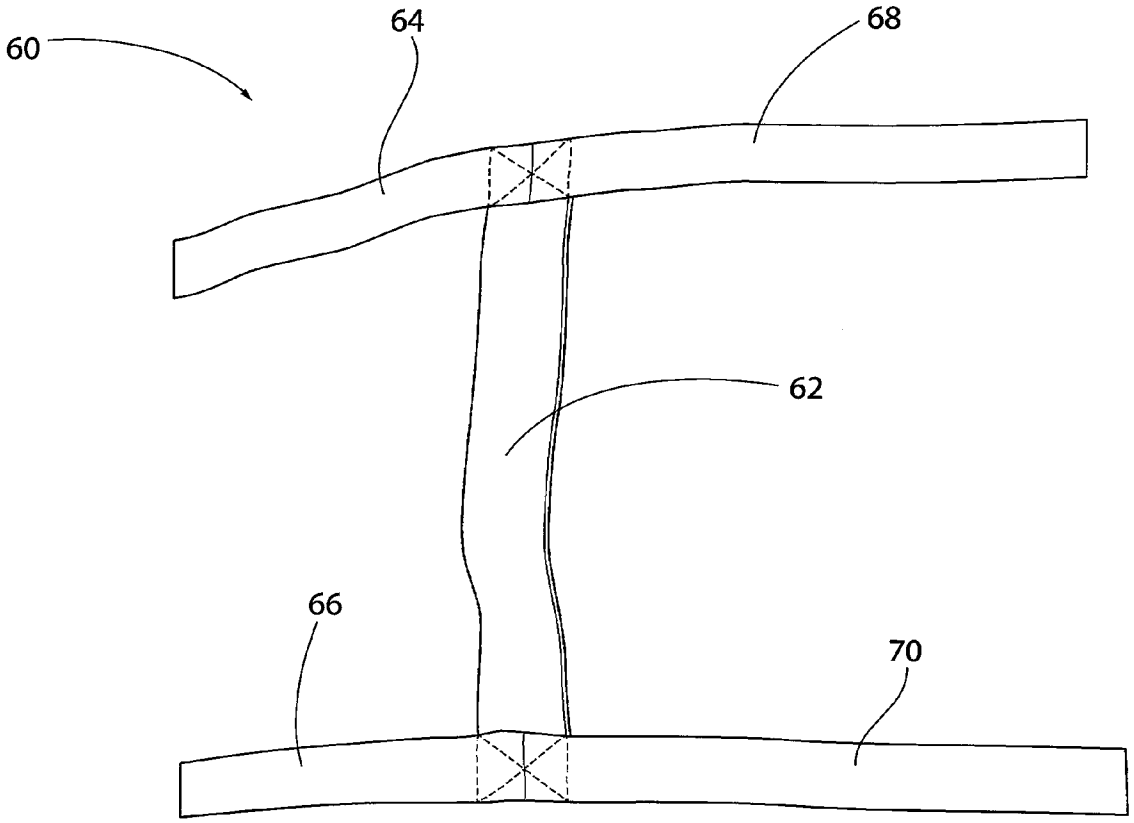
FIG. 10 is a top perspective view of an instep strap in accordance with the present invention.
Figure 11:
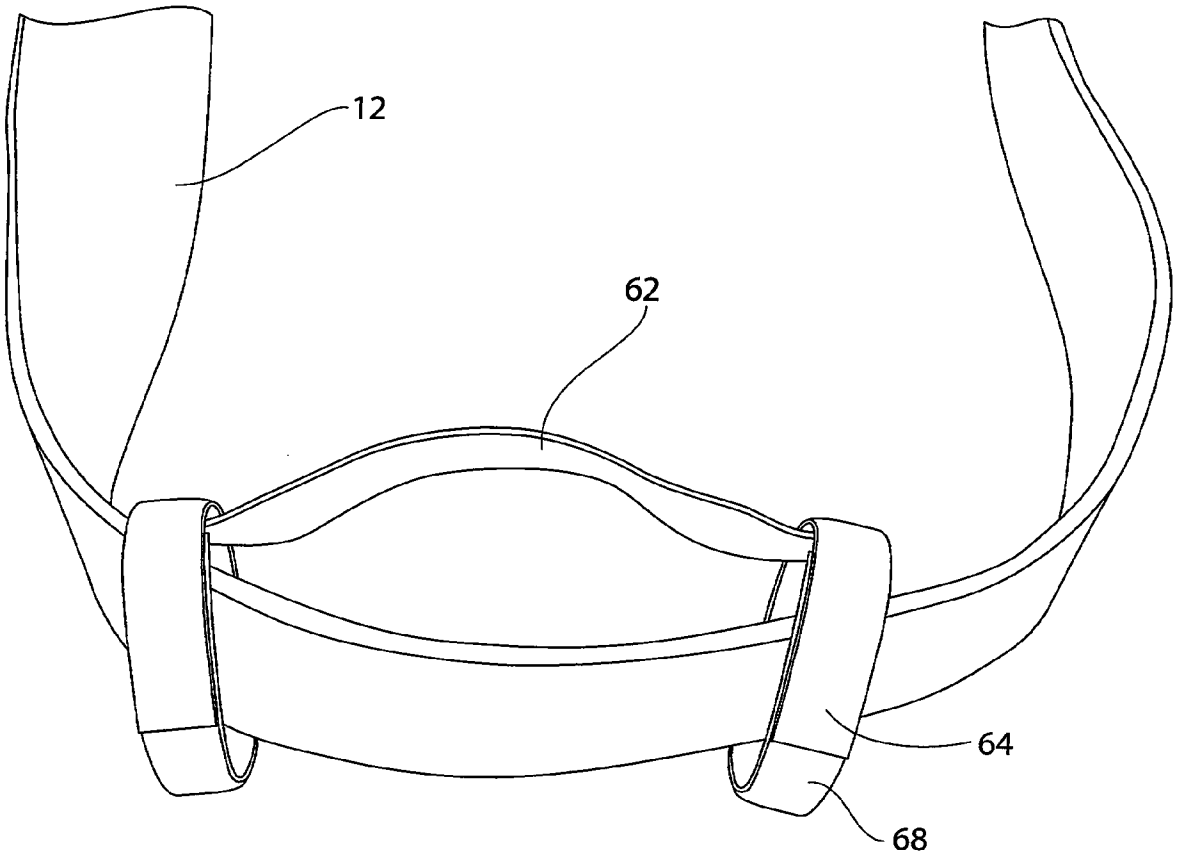
FIG. 11 is a front perspective view of the instep strap shown in FIG. 10 secured to the joint rehabilitation strap shown in FIG. 1.
Figure 12:
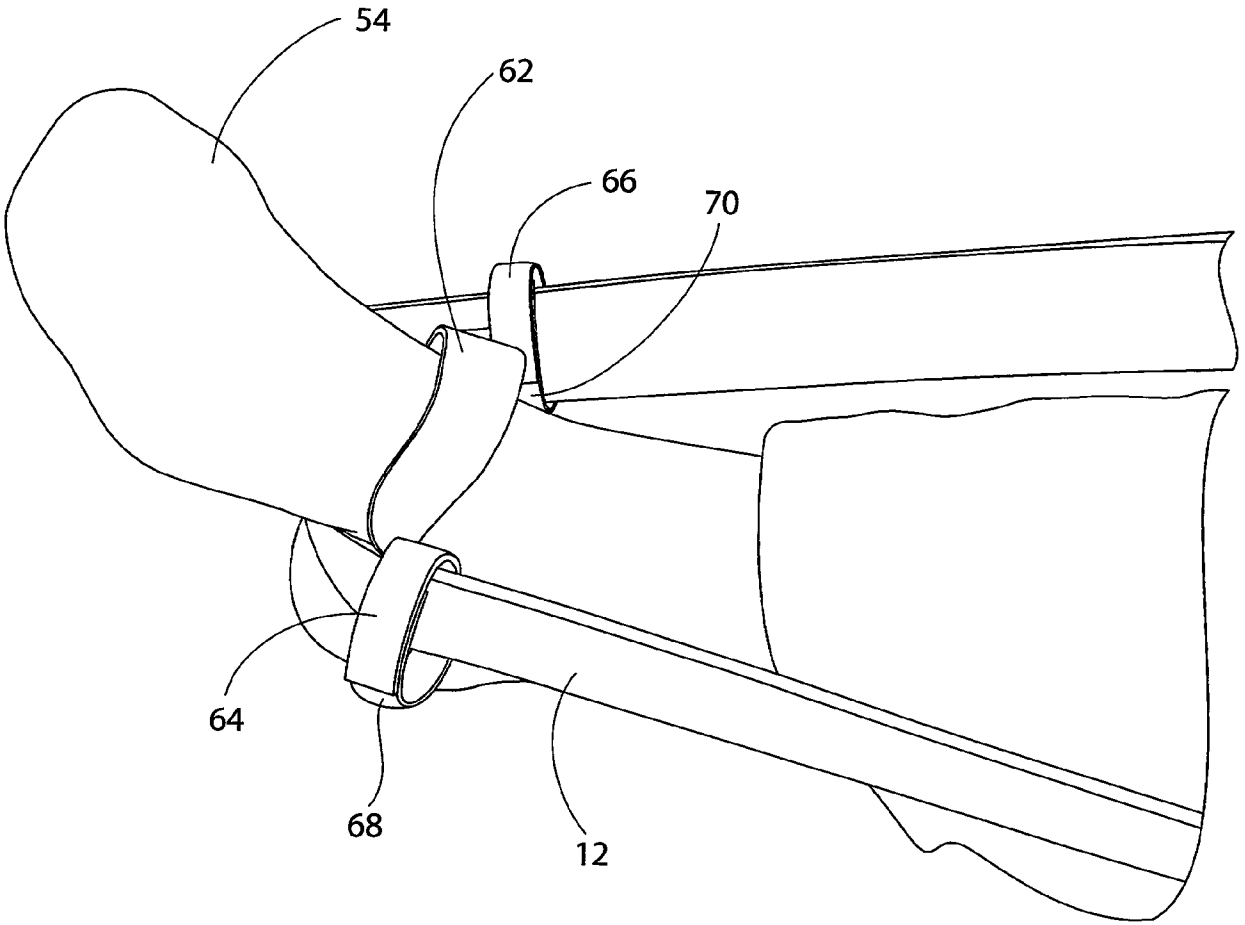
FIG. 12 is a side perspective view of a user's foot in the instep strap shown in FIG. 10 secured to the joint rehabilitation strap shown in FIG. 1.

Referring to FIGS. 10-12, the rehabilitation strap 10 can be used with instep strap 60 which can be attached to the flexible elongate body 12 to maintain a desired position on a user's foot 54. The instep strap includes a central elongate body 62, a first hoop strap 64, a second hoop strap 66, a first hook strap 68, and a second hook strap 70. The first hoop strap 64 is at least, in part, covered with hoop fasteners for fastening to first hook strap 68, which is at least, in part, covered with hook fasteners. Likewise, the second hoop strap 66 is at least, in part, covered with hoop fasteners for fastening to second hook strap 70, which is at least, in part, covered with hook fasteners. This arrangement of the first and second hoop straps, and the first and second hook straps allows the instep strap to be secured to the rehabilitation strap 10, by wrapping the respective straps around the rehabilitation strap 10 to secure the hook and loop fasteners, as shown in FIGS. 11 and 12. It is a particular advantage for many exercises that the flexible elongate body 12 is positioned at a particular location on a user's foot. For example, that the flexible elongate body 12 should be positioned on the toes or balls of the feet for stretching the user's plantar fasciitis, and the flexible elongate body 12 should be positioned at the arch of the user's foot for assisted leg bends. The instep strap 60 may be configured to contact the upper side of a user's foot 54 while the flexible elongate body 12 contacts the underside of a user's foot, thus encircling the foot. In some embodiments, the instep strap 60 will be in a fixed position and not adjustable, while in other embodiments it will be adjustable in length and/or position relative the flexible elongate body 12. This arrangement of the flexible elongate body 12 and instep strap 60 may form a close fit with the user's foot or may be a loose fit depending that particular application.

Figure 14:
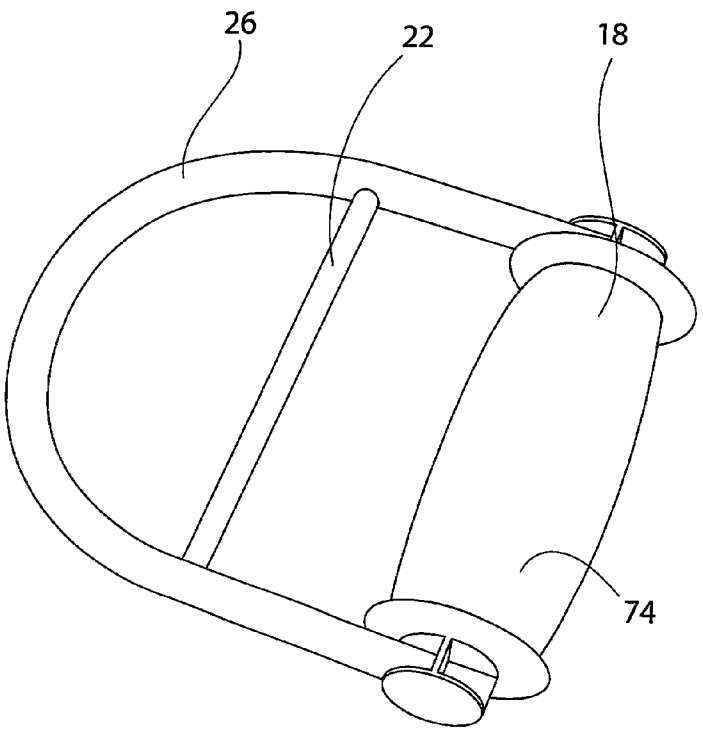
FIG. 14 is a perspective view of another embodiment of the handle of the joint rehabilitation strap shown in FIG. 1 with a foam grip covering.
Figure 13:
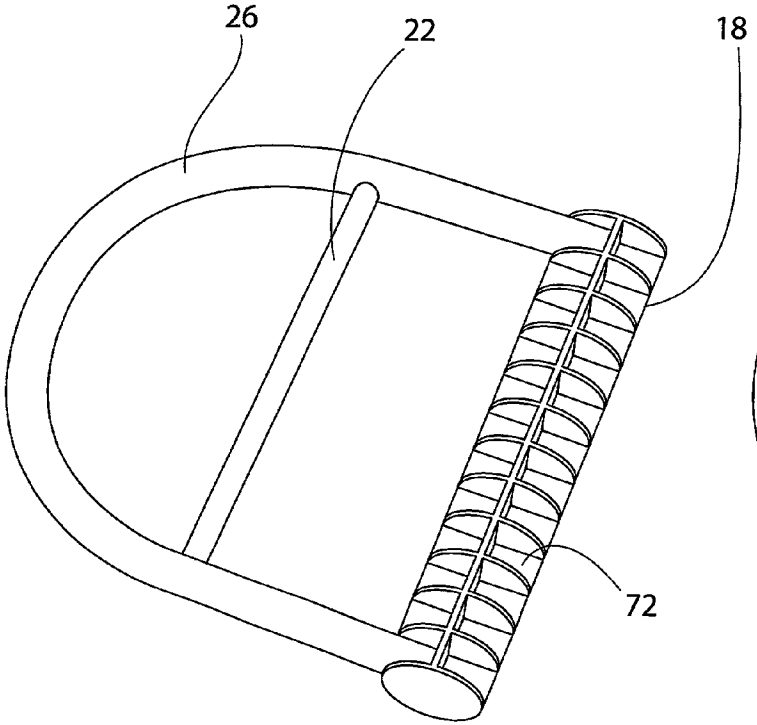
FIG. 13 is a perspective view of another embodiment of the handle of the joint rehabilitation strap shown in FIG. 1.

Referring to FIG. 13, the first handle 18 and the second handle 20 may also be contoured or shaped to fit a user's hand. Such contouring may include projections or ribs 72 for gripping. Referring to FIG. 14, the first handle 18 and the second handle 20 may comprise a softer material, at least at the surface, to aid a user in gripping the handles. The softer material may be a rubber, a rubberized polymer, a foam material, leather, or any suitable material. A foam grip covering 74, is shown in FIG. 14.

The invention claimed is:

1. A rehabilitation device comprising:

a flexible elongate body having a first end and a second end, a first D-shaped member flexibly coupled to the first end of said flexible elongate member, a second D-shaped member flexibly coupled to the second end of said flexible elongate member, a first handle attached to the first D-shaped member, a second handle attached to the second D-shaped member, a first elongate anti-pinch member disposed on the first D-shaped member between the first handle and the first end of said flexible elongate member, a second elongate anti-pinch member disposed on the first D-shaped member between the second handle and the second end of said flexible elongate member, wherein the first D-shaped member, the second D-shaped member, the first elongate anti-pinch member, the second elongate anti-pinch member, the first handle and the second handle are configured to prevent pinching of a user's hand when said user is gripping the first handle or the second handle.

2. The rehabilitation device of claim 1, wherein the first D-shaped member, the second D-shaped member, the first handle and the second handle are configured to prevent at least one of the first handle and the second handle from contacting the flexible elongate body.

3. The rehabilitation device of claim 1, wherein a length of the flexible elongate body is adjustable among a plurality of lengths.

4. The rehabilitation device of claim 1, wherein the flexible elongate body is configured as a strap.

5. The rehabilitation device of claim 1, wherein the flexible elongate body is configured as a cord.

6. A method of rehabilitating a joint, comprising the steps of:

providing a flexible elongate body having a first end and a second end, providing a first D-shaped member flexibly coupled to the first end of said flexible elongate member, providing a second D-shaped member flexibly coupled to the second end of said flexible elongate member, providing a first handle attached to the first D-shaped member, providing a second handle attached to the second D-shaped member, providing a first elongate anti-pinch member disposed on the first D-shaped member between the first handle and the first end of said flexible elongate member, providing a second elongate anti-pinch member disposed on the first D-shaped member between the second handle and the second end of said flexible elongate member, wherein the first D-shaped member, the second D-shaped member, the first elongate anti-pinch member, the second elongate anti-pinch member, the first handle and the second handle are configured to prevent pinching of a user's hand when said user is gripping the first handle or the second handle, gripping the first handle with a first hand of a user, gripping the second handle with a second hand of the user, positioning a portion of the flexible elongate body on a portion of a limb of the user so as to mechanically couple the flexible elongate body to the limb of the user, and moving the limb at least in part by the user pulling on at least one of the first handle and the second handle, thereby actuating a joint of the user.

7. The method of rehabilitating a joint of claim 6, wherein the first D-shaped member, the second D-shaped member, the first handle and the second handle are configured to prevent at least one of the first handle and the second handle from contacting the flexible elongate body.

8. The method of rehabilitating a joint of claim 6, wherein a length of the flexible elongate body is adjustable among a plurality of lengths.

9. The method of rehabilitating a joint of claim 6, wherein the flexible elongate body is configured as a strap.

10. The method of rehabilitating a joint of claim 6, wherein the flexible elongate body is configured as a cord.

* * * * *